United States Patent [19]

Harris

[11] Patent Number: 5,051,550

[45] Date of Patent: Sep. 24, 1991

[54] CONTROL MECHANISM FOR AN ON-OFF SWITCH

[75] Inventor: Timothy S. Harris, Fort Wayne, Ind.

[73] Assignee: Kransco, San Francisco, Calif.

[21] Appl. No.: 560,219

[22] Filed: Jul. 25, 1990

Related U.S. Application Data

[63] Continuation of Ser. No. 331,501, Mar. 31, 1989, abandoned.

[51] Int. Cl.[5] ..... H01H 21/24

[52] U.S. Cl. ..... 200/330; 200/332.1; 200/339; 200/557

[58] Field of Search ..... 200/339, 332, 332.1, 200/557, 330, 335, 343, 553

[56] References Cited

U.S. PATENT DOCUMENTS

| | | | |
|---|---|---|---|
| 3,225,156 | 12/1965 | Sahrbacker | 200/557 X |
| 3,319,031 | 5/1967 | Butler et al. | 200/339 X |
| 4,292,485 | 9/1981 | Kondo et al. | 200/332 |

FOREIGN PATENT DOCUMENTS

| | | | |
|---|---|---|---|
| 1138448 | 10/1962 | Fed. Rep. of Germany | 200/330 |
| 2810368 | 9/1979 | Fed. Rep. of Germany | 200/339 |
| 1520451 | 7/1975 | United Kingdom | 200/330 |

*Primary Examiner*—Renee S. Luebke

*Attorney, Agent, or Firm*—Kolisch, Hartwell, Dickinson, McCormack & Heuser

[57] ABSTRACT

A control mechanism operable for selectively moving an on-off switch into on and off positions includes an on-off switch having opposed, first and second ends simultaneously movable in opposite directions, an actuator disposed adjacent the on-off switch selectively movable for engaging the first end of the on-off switch and urging it in a first direction to an on position accompanied by movement of the second end of the on-off switch in the opposite direction, and a biasing device disposed adjacent the on-off switch and externally thereof for engaging the second end of the on-off switch and normally maintaining it in the off position. The biasing device yieldably resists movement of the actuator when it engages the first end of the on-off switch and moves it in the first direction toward the on position.

13 Claims, 1 Drawing Sheet

CONTROL MECHANISM FOR AN ON-OFF SWITCH

This application is a continuation of prior filed application Ser. No. 07/331,501, filed Mar. 31, 1989, abandoned with the filing of this continuation application.

BACKGROUND AND SUMMARY OF THE INVENTION

The present invention relates to control mechanisms for on-off switches, and more particularly to a novel control mechanism which ensures that an on-off switch will be maintained in an off position once it has been switched off. In particular, the present invention relates to a control mechanism having applicability to an on-off switch which is used in connection with a foot pedal or hand actuating device used to interconnect a battery with a motor to provide power, as for example, on toys such as children's ride-on vehicles.

In some models of children's battery-powered ride-on vehicles, power is transmitted from the battery to a driving motor by means of a selectively actuable on-off switch. Such switches may take the form of a rocker switch or the like which is mounted in a housing, appropriately disposed adjacent the floorboard of the vehicle. A foot pedal or the like is positionable above the rocker switch and includes an element projecting therefrom for engaging a first end of the rocker switch, when the foot pedal is suitably depressed, to urge that end downwardly so a contact interconnects the battery with the motor. The rocker switch is normally biased to an off position by means of a return spring, and the foot pedal must be depressed with sufficient force to overcome the tension of the return spring so that the rocker switch may be moved to the on position. When the foot pedal is released, the return spring moves the rocker switch into the off position.

A problem resides in conventional foot pedal/on-off switch constructions as above described because return springs may break after being cycled repeated times. When the foot pedal is released, so that it moves to the normally off position, the rocker switch remains in the on position. The result is a vehicle in which the battery remains interconnected with the driving motor so that the vehicle continues to travel. Such a "run-away vehicle" is a frightening as well as potentially very dangerous situation to a child rider. The present invention seeks to avoid that problem.

While there are several devices in the prior art which show various types of safety switches, most are relatively complex constructions utilizing many movable parts and may be expensive. Indicative of some ideas for safety switches are the devices shown in Williams (3,409,101) which relates to motor vehicles; Miller (4,172,217); Buzzell (3,233,071); Hansen (3,358,108); Ruben (2,944,120); and Quisenberry (2,917,122).

With the above problems as described in mind, it is a general object of the present invention to provide a novel control mechanism operable for selectively moving an on-off switch into on and off positions by utilizing an actuating means disposed adjacent the switch selectively operable for engaging a first end of the switch and urging it in a first direction to an on position accompanied by movement of the second end of the switch in the opposite direction, wherein a biasing means is provided for engaging the second end of the switch and normally maintaining it in the off position, with the biasing means yieldably resisting movement of the actuating means when it engages the first end of the switch and moves it in the first direction toward the on position.

It is another object of the present invention to provide a control mechanism, as described above, in which the biasing means is configured as a leaf or clip spring, having a first portion thereof affixed to the actuating means with another portion normally engaging the switch's second end. When the actuating means is moved to the off position, the end of the clip spring normally engaging the second end of the switch continues to bias that end into the off position, thereby preventing the switch from being inadvertently permitted to remain in the on position should the return spring break.

Another object of the present invention is to provide a control mechanism, as described above, in which the biasing means for engaging the second end of the switch includes a second embodiment defined by a leaf-spring which is not U-shaped in cross section.

Still another object of the present invention is to provide a control mechanism, in another embodiment, in which the biasing means is defined by an elongate leaf-like spring which is formed as a bow, mounted to the actuating means, which engages the switch and maintains it normally in an off position.

These and additional objects and advantages, as well as another embodiment of the invention, will be more readily understand after a consideration of the drawings and the detailed description of the preferred embodiments.

DETAILED DESCRIPTION OF THE PREFERRED EMBODIMENTS

Figure 1:
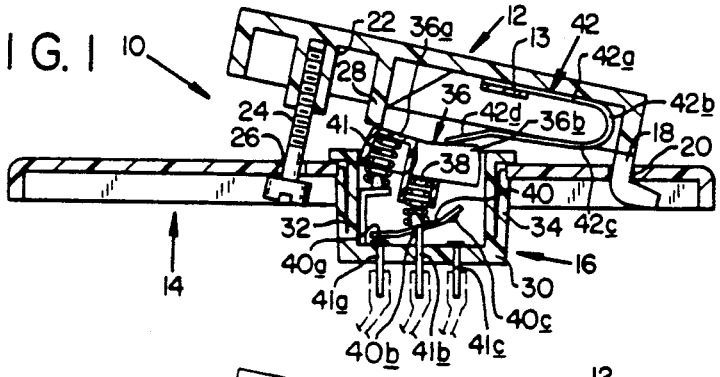
FIG. 1 is a side elevational view, taken in cross section, showing a control mechanism of the present invention including an actuating means defined by a foot pedal, positioned in the "off" position relative to an on-off switch, with the biasing means being formed generally as a U-shaped clip spring.

As mentioned at the outset, it is a principal object of the present invention to provide a control mechanism operable for selectively moving an on-off switch into on and off positions which includes an actuating means and a biasing means for normally maintaining the switch in the off position, with the biasing means yieldably resisting movement of the actuating means when the switch is engaged and moved into its on position. As shown in FIG. 1 a control mechanism according to the present invention is generally indicated at 10. The control mechanism is shown in side elevational view, and is also illustrated in cross section with an actuating means, such as a foot pedal, generally indicated at 12 pivotally mounted to a base plate generally indicated at 14, which in turn is suitably mounted to the floorboard or the like of a children's ride-on vehicle, for example.

An on-off switch such as an on-off rocker switch assembly is generally indicated at 16 and is mounted within an aperture suitably provided in the base plate. Pedal 12 is provided with a hook member 18 which is insertable through aperture 20 provided in base plate 14 to enable the pedal to be pivoted relative thereto to actuate on-off switch 16 in a manner to be described. Mounted near the front of pedal 12 and extending downwardly therefrom is an internally threaded sleeve 22 for threadably receiving a screw 24 which is inserted through an aperture 26 provided in the base plate. Screw 24 provides a limit means for limiting the extent to which the pedal can be pivoted in a clockwise direction as shown in FIG. 1. Pedal 12 is provided with an element or abutment means 28 which extends downwardly therefrom for engaging on-off switch 16 in a manner to be described.

On-off switch 16 is of conventional construction, and includes a housing 30 provided with spring-like sides 32, 34 which enable the housing to be snapped into position on base plate 14. Mounted within housing 30 is a rocker switch 36 having a first end **36*a* and second and 36*b*. The rocker switch is mounted in the assembly by means of a small coil spring 38 mounted in turn onto a rocker arm 40 which is a conductor having contacts 40*a*, 40*b* and 40*c*. Those contacts interconnect with contacts 41*a*, 41*b* and 41*c*, depending on the position of rocker switch 36. A return means such as a return spring is shown at 41, and normally urges pedal 12 in a clockwise direction to the so-called "off" position. The pedal, which is shown in cross section, may have a length in the range of 2–3 inches and a width of 1–2 inches, as is typical. Thus far, everything which has been described is conventional, and attention is now directed to a novel biasing means of the present invention generally indicated at 42**.

The biasing means, as shown in the embodiment of FIG. 1, is a flexible member such as a generally U-shaped clip spring which includes a first portion **42*a* which transitions by means of curved portion 42*b* into portion 42*c*. The biasing means is disposed adjacent the on-off switch and externally thereof. At the end of portion 42*c*, there is provided a bent or offset end 42*d* which ensures continuous engagement with second end 36*b* of rocker switch 36. The biasing means is suitably secured to pedal 12, by means of a fastener 13, and is provided with adequate spring tension so that it engages second end 36*b* and normally maintains it in the off position. The biasing means, however, also is designed for yieldably resisting movement of pedal 12, and storing up spring tension, when abutment means 28 engages first end 36*a*** and moves it in a first direction toward the on position. The slip spring may be dimensioned approximately 1 inch in width and 2¼ inches in length. Suitable material for the spring (and in the other embodiments as well) may include stress-relieved stainless steel or the like.

Figure 2:
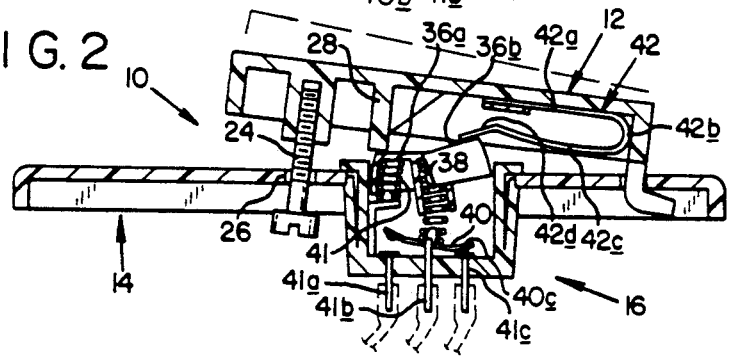
FIG. 2 is a view, similar to FIG. 1, illustrating the actuating means in its fully depressed position, whereby the on-off switch is positioned in the "on" position and showing the biasing means which engages the switch's second end being yieldable for enabling the switch to be positioned in the on position.

As shown in FIG. 2, pedal 12 has been fully depressed, and because the first and second ends of rocker switch 36 are movable simultaneously in opposite directions, contact **40*c* of rocker arm 40 now engages contact 41*c*. The principal reason for provision of biasing means 42 is as follows. Return spring 41, being of very small size, can break after repeated cycling, resulting in a run-away vehicle even when pressure is removed from foot pedal 12 because there is no force to return rocker switch 36 to an off position. However, biasing means 42 will urge second end 36*b* of the rocker switch toward the off position if return spring 41** should fail.

As shown in FIG. 2, it can be seen that when pedal 12 is depressed so that the rocker switch is in the on position, biasing means 42 is deflected so that portion **42*c* is displaced toward portion 42*a*, i.e., it yieldably resists movement of the pedal. Because biasing means 42 is provided with offset end 42*d*, that portion maintains its grip on second end 36*b* of the rocker switch. Then, when foot pressure is removed from foot pedal 12, biasing means 42, having stored up spring tension, urges second end 36*b* downwardly and returns it to the position shown in FIG. 1. Thus, it can be appreciated that if return spring 41 fails, it is impossible for the vehicle, or whatever device switch 16 operates, to continue to run in the on position. Biasing means 42 efficiently provides a safety override for the on-off switch, which is normally biased into an off position. The biasing means also urges pedal 12 into an off position. Once pedal 12 is released, on-off switch 36 will be biased into its off position because of biasing means 42**.

Figure 3:
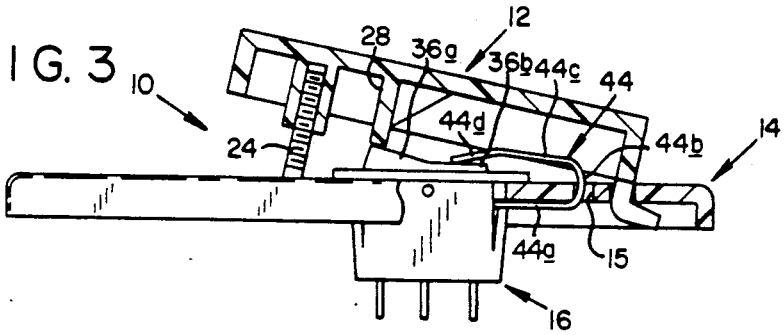
FIG. 3 is a view, similar to FIGS. 1 and 2, of a second embodiment of the present invention.
Figure 4:
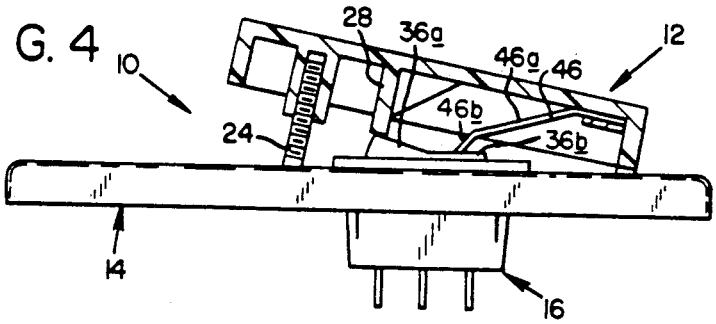
FIG. 4 is a view, similar to the other views, of a third embodiment of the present invention.
Figure 5:
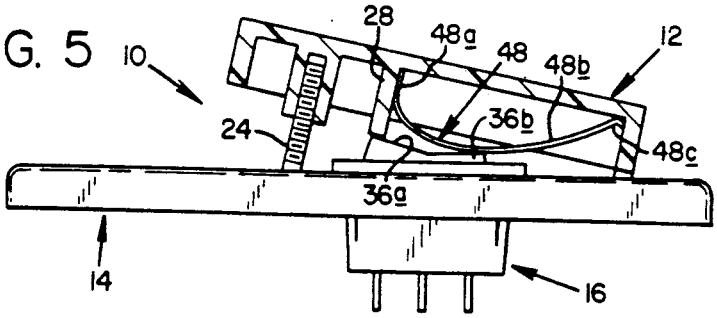
FIG. 5 is a view, similar to the other views, of a fourth embodiment of the present invention.

FIGS. 3–5 show alternative embodiments of the present invention. For example, FIG. 3 shows a second embodiment in which a biasing means 44, which may take the form of a leaf-like or clip spring, is mounted to base plate 14 and includes a portion **44*a* disposed on the underneath side of the base plate. It will be noted that base plate 14 is provided with an aperture 15 to allow reception therethrough of portion 44*b* of the biasing means which transitions into a substantially straight overlapping portion 44*c*. Portion 44*c* transitions into bent or offset end 44*d* which ensures gripping onto the second end of the rocker switch. Biasing means 44 is again constructed as a clip spring 42, with the difference being that it is not mounted on pedal 12 as in the first embodiment shown in FIGS. 1 and 2. However, biasing means 44 still returns pedal 12 to its off position, when a downwardly depressing force is not applied to the foot pedal, because the first end of the rocker switch engages against abutment means 28 to urge pedal 12 upwardly by virtue of the spring action of biasing means 44**.

FIGS. 4 and 5 show additional embodiments. The FIG. 4 or third embodiment of the present invention contemplates that a biasing means 46 is dimensioned to extend with an elongate arm **46*a* from the underneath side of pedal 12 as shown. A bent or offset end 46*b* also ensures adequate gripping of the second end of the rocker switch. Thus, the embodiment shown in FIG. 4** is a clip spring which extends substantially directly from the pedal for engaging the rocker switch.

Finally, the fourth embodiment, as shown in FIG. 5, contemplates the use of a biasing means formed as a flexible, generally bow-shaped spring member indicated at 48 which has an arcuate portion of the bow continuously engaging the second end of the rocker switch. The bow spring includes a forward portion **48*a* mounted adjacent abutment means 28 and an elongate mid portion 48*b*, formed as an elongate arc, which engages the rocker switch. An end portion 48*c* of the biasing means is secured to an end of pedal 12** as shown.

While the present invention has been shown and described with reference to the foregoing preferred embodiments, it is to be understood by those skilled in the art that other changes in form and detail may be made therein without departing from the spirit and scope of the invention as defined in the appended claims.

It is claimed and desired to secure by Letters Patent:

1. A control mechanism operable for selectively moving an off-on switch into its on and off positions comprising:

in combination with a switch having opposed, first and second ends simultaneously movable in opposite directions, the switch achieving one switching state by movement of the first end in one of said directions and a second switching state by movement of the second end in said one of said directions;

actuating means disposed adjacent the switch selectively movable for engaging the first end of the switch and urging the first end in said one direction to produce said one switching state, this movement being accomplished by movement of the second end of the switch in the opposite direction;

said switch including return means for engaging the first end of the switch and normally urgin the first end in said opposite direct and the second end in said one direction to produce the second switching state; and biasing means disposed adjacent the switch and externally thereof engaging the second end of the switch and continuosly urging the second end of the switch in said one direction to produce said second switching state, said biasing means thus complementing the urging of said return means and yieldably resisting movement of the actuating means.

2. The combination of claim 1 wherein the biasing means is mounted on a base plate which supports the switch.

3. The combination of claim 2 wherein the biasing means is a flexible, generally U-shaped clip spring.

4. In combination with a switch having opposed, first and second ends simultaneously movable in opposite directions, the switch achieving one switching state by movement of the first end in one of said directiobns and a second switching state by movement of the second end in said one of said directions;

actuating means disposed adjacent the switch selectively movable for engaging the first end of the switch and urging it in said one direction to place the switch in its said one switching state with such movement accompanied by movement of the second end of the switch in the opposite direction; and biasing means disposed adjacent the switch and externally thereof for engaging the second end of the switch and normally maintaining the switch in the second switching state by urging the second end in said one direction, the biasing means yieldably resisting movement of the actuating means when the actuating means engages the first end of the switch and moves the first end in the first direction, the biasing means being a flexible member secured to the actuating means and extending toward the switch.

5. The combination of claim 4 wherein the biasing means is a flexible, generally bow-shaped spring member having an arcuate portion thereof continuously engaging the second end of the switch.

6. The combination of claim 4 wherein the biasing means is a generally U-shaped clip spring formed with a portion which continuously engages the second end of the switch.

7. The combination of claim 6 wherein the portion of the clip spring engaging the second end of the switch is offset from an adjacent portion to ensure continuous engagement with the second end.

8. The combination of claim 7 wherein the clip spring stores up spring tension when the actuating means moves the first end of the switch in said one direction.

9. A control mechanism operable for selectively moving an on-off rocker assembly between on and off positions, the switch assembly having opposed first and second ends simultaneously moveable in opposite directions about a common axis, the control mechanism comprising:

actuating means disposed adjacent the switch assembly selectively movable for engaging the first end of the switch assembly and urging it in a first direction to an on position accompanied by movement of the second end of the switch assembly in the opposite direction; and biasing means disposed adjacent the switch assembly and externally thereof for engaging the second end of the switch assembly and normally maintaining it in the off position, the biasing means yieldably resisting movement of the actuating means when it engages the first end of the switch assembly and moves it in the first direction toward the on position, the biasing means being defined by a flexible member secured to the actuating means and extending toward the switch assembly.

10. The control mechanism of claim 9 wherein the actuating means is a foot pedal.

11. The control mechanism of claim 9 wherein the biasing means is a generally U-shaped clip spring formed with a portion which continuously engages the second end of the on-off switch.

12. The control mechanism of claim 11 wherein the portion of the clip spring engaging the second end of the on-off switch is offset from its adjacent portion to ensure continuous engagement with the second end.

13. The control mechanism of claim 11 wherein the clip spring stores up spring tension when the actuating means moves the first end of the on-off switch into the on position.

* * * * *